US006877441B2

(12) United States Patent
Zheng

(10) Patent No.: US 6,877,441 B2
(45) Date of Patent: Apr. 12, 2005

(54) FOLDABLE TABLE

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 88 days.

(21) Appl. No.: 10/434,720

(22) Filed: May 8, 2003

(65) Prior Publication Data

US 2004/0221774 A1 Nov. 11, 2004

(51) Int. Cl.[7] ..... A47B 3/00
(52) U.S. Cl. ..... 108/130; 108/132
(58) Field of Search ..... 108/132, 131, 108/130, 129, 115; 248/439, 166, 188.6

(56) References Cited

U.S. PATENT DOCUMENTS 5,390,610 A * 2/1995 Gutgsell ..... 108/132
5,562,051 A * 10/1996 Rizzi ..... 108/132
5,606,922 A * 3/1997 Adams et al. ..... 108/129
5,983,807 A * 11/1999 Tarnay et al. ..... 108/132
6,112,674 A * 9/2000 Stanford ..... 108/132
6,471,173 B1 * 10/2002 Tseng ..... 248/439
6,520,094 B2 * 2/2003 Wen ..... 108/132
6,615,743 B2 * 9/2003 Nien ..... 108/132
6,622,644 B2 * 9/2003 Buono ..... 108/132
6,732,663 B2 * 5/2004 Tsai ..... 108/132

* cited by examiner

*Primary Examiner*—Jose V. Chen
(74) *Attorney, Agent, or Firm*—Rutan & Tucker

(57) ABSTRACT

A foldable table includes a table top coupled to a frame, and a pedestal that is movably coupled to the frame via a first and second element, wherein first and second elements are coupled via a connector such that the connector limits a movement in which the table is unfolded from a closed configuration to an open configuration.

14 Claims, 4 Drawing Sheets

FOLDABLE TABLE

FIELD OF THE INVENTION

The field of the invention is foldable furniture, and especially foldable tables.

BACKGROUND OF THE INVENTION

Foldable furniture, and especially foldable tables are relatively popular and numerous manners of making tables foldable are known in the art. For example, many foldable tables include legs that are directly attached to the table at one end of the leg via a pivot, while other tables include legs that are removably attached to the table via a pivot. Direct attachment via a pivot is typically relatively simple, however, often requires considerable space for folding the legs and may pose risk of unintended collapse of the table when the table is being pushed in one or another direction. Removable legs significantly improve stability, however, folding tables with removable legs is often cumbersome.

Other known foldable tables include legs in which one or two legs are attached to the table via a four bar link, wherein the bars of the four bar link are attached on the sides of the table. For example, Ladd describes in U.S. Pat. No. 4,41,569 a foldable bed in which a four bar link is coupled to the side rails of the bed and assists folding of the front and rear legs. Similarly, as shown in U.S. Pat. Nos. 2,057,778 and 2,318,945, a four bar link mechanism in a foldable table is attached to side rails of the table. Alternatively, Pucci describes in U.S. Pat. No. 2,666,683 a foldable table in which the four bar link is attached to the inside surface of the table circumference, thus allowing stacking/folding of the table when the legs are folded underneath the table. However, in such configurations, the stability is greatly dependent on the table circumference. Still further, Puccis's configurations without a specific locking mechanism are more likely to collapse when the table is being pushed in one or another direction.

Alternatively, a modified four bar link may be employed in which a pedestal is slidably and pivotably coupled to the table (via a bracket) as described in U.S. Pat. Nos. 2,695,827 and 2,657,963 to deSaussure and Fox, respectively. While such configurations are especially advantageous where tables are stacked on top of each other in the closed configuration, stability is frequently less than desirable, especially where an end-to-end force is applied to the table.

In still further known tables, as described in U.S. Pat. No. 4,838,180 5,636,578, the four bars of the four bar link may be attached to a mounting platform, which is in turn attached to the table top. Such configurations advantageously allow positioning of the leg or legs in a more central position (i.e., between the sides of the table, and/or between the ends of the table). However, to provide at least some stability to the table, the mounting platform typically requires solid attachment to the underside of the table top, and further requires that the table top is of sufficient rigidity to accommodate front-to-back and/or side-to-side forces impinging on the table. Therefore, mounting platforms are generally not useful in conjunction with a table top made from light-weight material (e.g., blow molded plastic). While such configurations may add at least some stability and ease of folding, various disadvantages still remain. Among other things, where the four bar link is attached to the sides or side rails, stacking of such tables id often problematic as the legs protrude from the underside of the table.

Thus, while numerous configurations for folding tables are known in the art, all or almost all of them suffer from one or more disadvantages. Therefore, there is still a need to provide improved apparatus and methods for foldable tables, and especially foldable tables with a four bar link.

SUMMARY OF THE INVENTION

The present invention is directed to configurations and methods for foldable tables in which the table is folded in a single movement, and in which the table has a pedestal that is coupled to a frame via pivotable elements.

In one aspect of the inventive subject matter, the foldable table has a table top coupled to a frame, and a pedestal that is movably coupled to the frame via a first and second element, wherein first and second elements are pivotably coupled to the frame, and wherein a connector couples the first and second elements such that the connector limits a movement in which the table is unfolded from a closed configuration to an open configuration.

Especially preferred table tops include blow mold table tops, and particularly preferred frames include a first and a second side rail, a first and a second end rail, and a cross rail. It is still further particularly preferred that the first element comprises a swivel bar and the second element comprises a pivot bar, wherein the swivel bar is pivotably coupled to the pedestal and the cross rail, and wherein the pivot bar is pivotably coupled to the pedestal and to the end rail. In other preferred aspects of the inventive subject matter, the connector is pivotably and/or telescopingly coupled to the pedestal and at least one of the swivel bar and the pivot bar.

Therefore, in a particularly preferred aspect of the inventive subject matter, a foldable table has a table top coupled to a frame that includes a first and a second side rail, a first and a second end rail, and a cross rail. Such preferred tables further include a pedestal that is disposed between the first and second side rails and coupled to the frame via a first and second swivel bar and a first and second pivot bar, wherein the first and second swivel bars are pivotably coupled to the pedestal and pivotably coupled to the cross rail, and wherein the first and second pivot bars are pivotably coupled to the pedestal and pivotably coupled to the end rail. A connector in such tables is pivotably coupled to at least one of the pedestal and the first or second swivel bars, wherein the connector is further coupled to at least one of the pivot bars such that the connector limits a movement in which the table is unfolded from a closed configuration to an open configuration.

Various objects, features, aspects and advantages of the present invention will become more apparent from the following detailed description of preferred embodiments of the invention, along with the accompanying drawings in which like numerals represent like components.

DETAILED DESCRIPTION

The inventors have discovered that highly stable, yet in most embodiments light weight foldable tables may be constructed using a frame in which a pedestal is movably coupled to a frame via a first and second pivotable element, wherein (at least in some preferred aspects) the pedestal, and the first and second elements are coupled to each other via a connector that limits movement in which the table is unfolded from a closed configuration to an open configuration.

Figure 1:
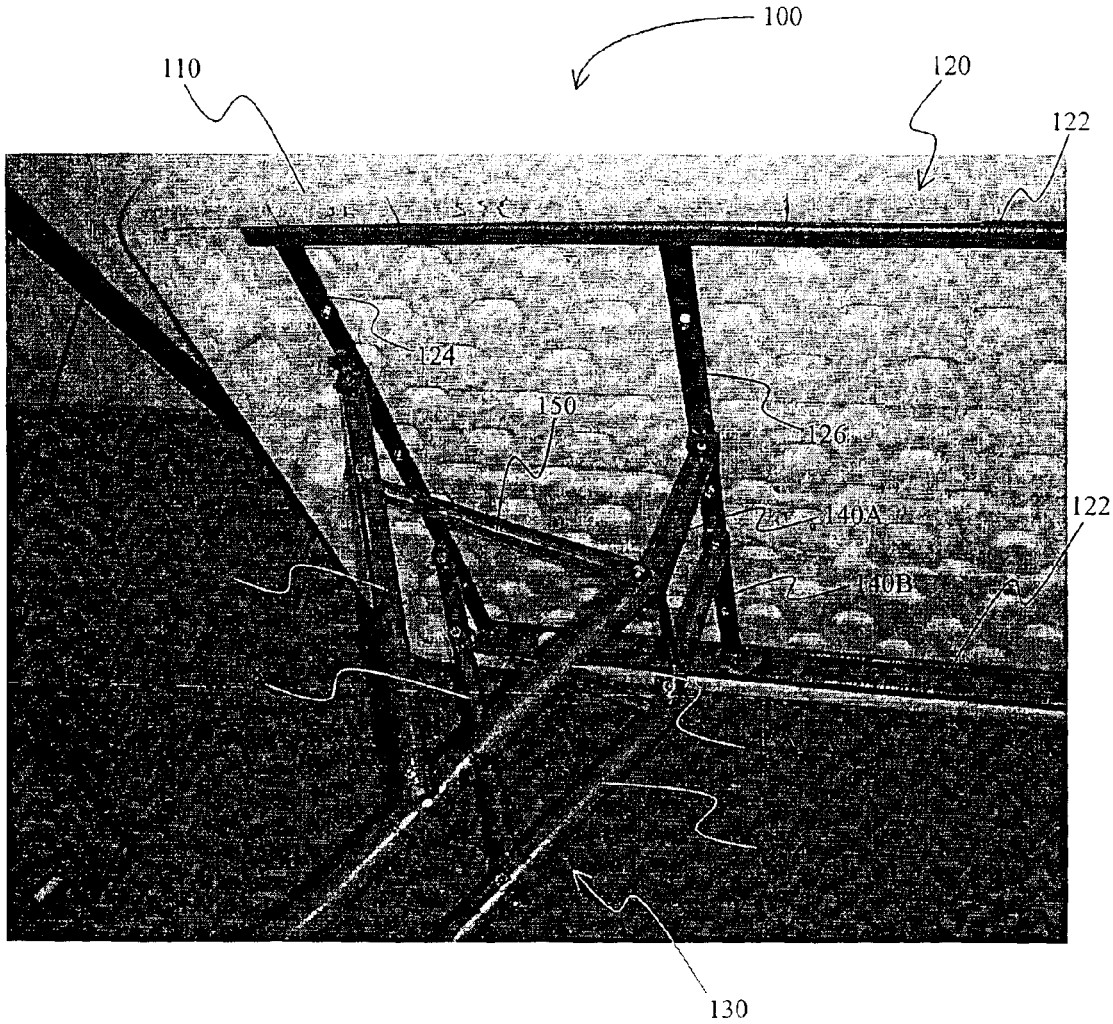
FIG. 1 is an exemplary table according to the inventive subject matter in which one of the pedestals is in the open configuration.

In one aspect of the inventive subject matter as shown in FIG. 1, a table 100 has a table top 110 and a frame 120 having a pair of side rails 122, a pair of end rails 124 (only one shown), and a pair of cross rails 126 (only one shown). A pedestal 130 has load-bearing columns 132 and 134 that are coupled to the frame via a pair of swivel bars 140A and 140B, which are on one end pivotably coupled to the cross rail 126, and which are on the other end pivotably coupled to the upper end of the load-bearing columns 132 and 134, respectively. A pair of pivot bars 136 and 138 is on one end pivotably coupled to the end rail 124 and is on the other end pivotably coupled to the load-bearing columns 132 and 134, respectively, at a position below the coupling with the swivel bar (when the table is in the open configuration). A connector 150 is pivotably coupled to the joint where the swivel bar 140A is coupled to the load bearing column 132 and pivotably and slidably coupled to the pivot bar 136. The frame 120 is coupled to the table top 110 via screws (not shown) that connect the end and cross rails with the underside of the table top, and screws (not shown) that connect the ends of the side rails with the inner circumferential portion of the table top.

As used herein, the term "disposed between the first and second side rails" refers to a position that is located in a space that is delimited by the innermost portions of the side rails and that expressly excludes the side rails. Therefore, a pedestal that directly or via a pivot contacts a portion of the side rail is not considered between the first and second side rails. In contrast, pedestals of tables contemplated herein are typically at least 1 cm, and more typically at least 10 cm apart from the innermost portion of a side rail.

As also used herein, the term "swivel bar" refers to an element that pivotably couples the pedestal to the frame, wherein the swivel bar is pivotably coupled to both the end rail and the frame (e.g., via cross rail). Most preferably, the pivotable coupling of the swivel bar to the pedestal and the frame is in a position at, or proximal (i.e., within less than 25% of the total length of the swivel bar) to the ends of the swivel bar. Similarly, the term "pivot bar" as used herein refers to an element that pivotably couples the pedestal to the frame (e.g., via end rail), wherein the pivot bar is pivotably coupled to both the frame and the pedestal. Most preferably, the pivotable coupling of the pivot bar to the pedestal is in a position distal (i.e., within at least 10% of the total length of the swivel bar) to the upper end of the pedestal (when the table is in the open configuration).

As further used herein, the term "open configuration" refers to a configuration of the table in which the pedestal or pedestals are folded away from the table top such that the pedestals will support the table top off the ground. Therefore, the term "open configuration" is particularly used when the table is in operation, i.e., both pedestals are folded away from the table top and support the table off the ground. Similarly, the term "closed configuration" refers to a configuration of the table in which the pedestal or pedestals are folded towards the table top. Therefore, the term "closed configuration" is particularly used when the table is not in operation and stored away, i.e., both pedestals are folded towards the table top.

As still further used herein, the term "in a single movement" refers to a movement in which the table is converted from the closed configuration to the open configuration (or vice versa) without unlocking a locking mechanism or without at least momentarily interrupting the movement to unlock a locking mechanism (e.g., slide ring, lever, bolt, etc.) that would otherwise prevent the pedestal from moving form one configuration into another configuration.

Figure 2:
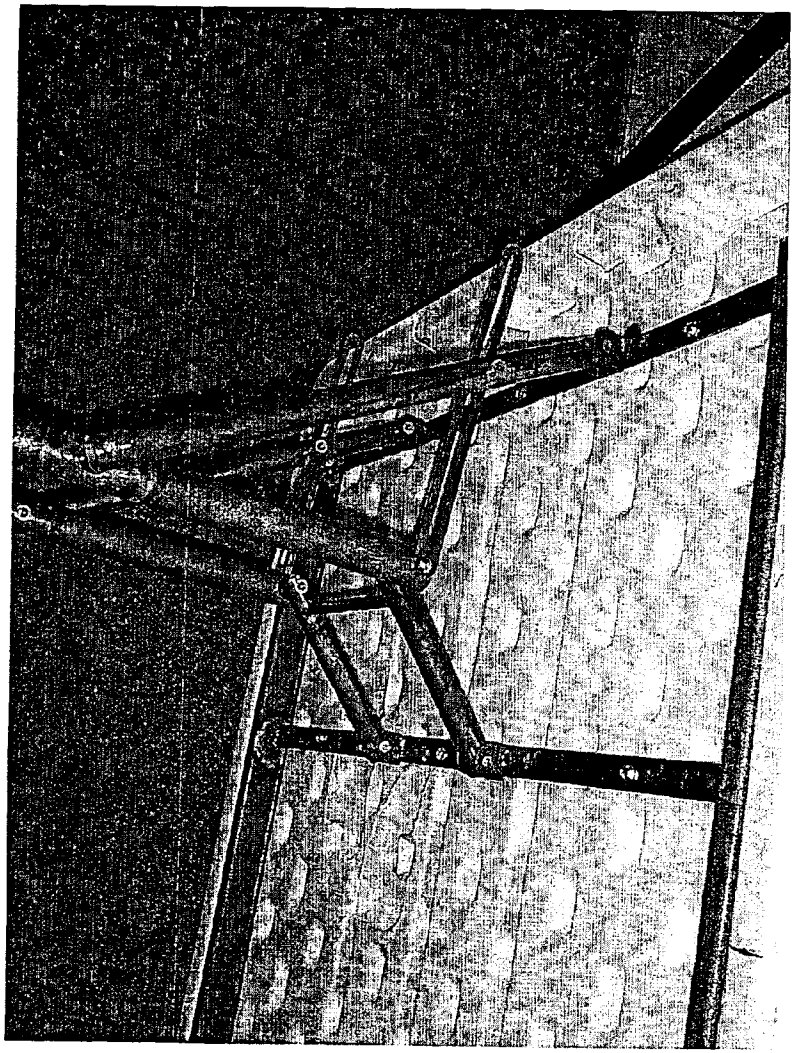
FIG. 2 is the exemplary table of FIG. 1 in which the pedestal is in a partially closed configuration.
Figure 3:
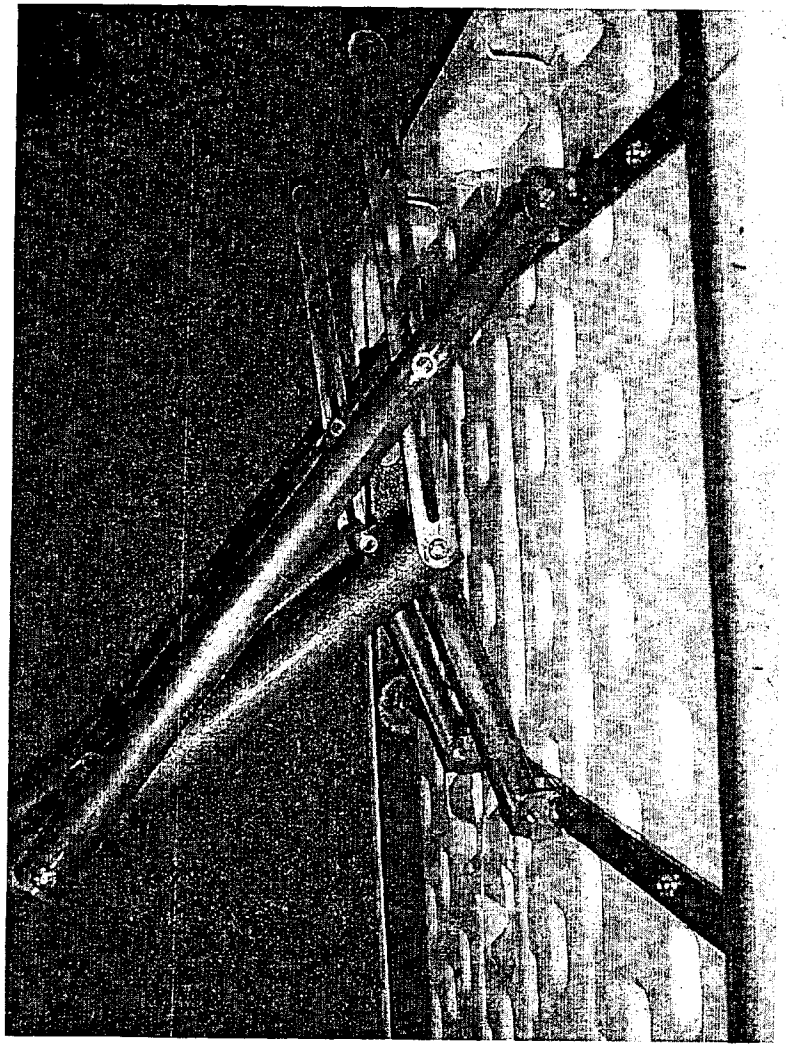
FIG. 3 is the exemplary table of FIG. 2 in which the pedestal is in a further partially closed configuration.
Figure 4:
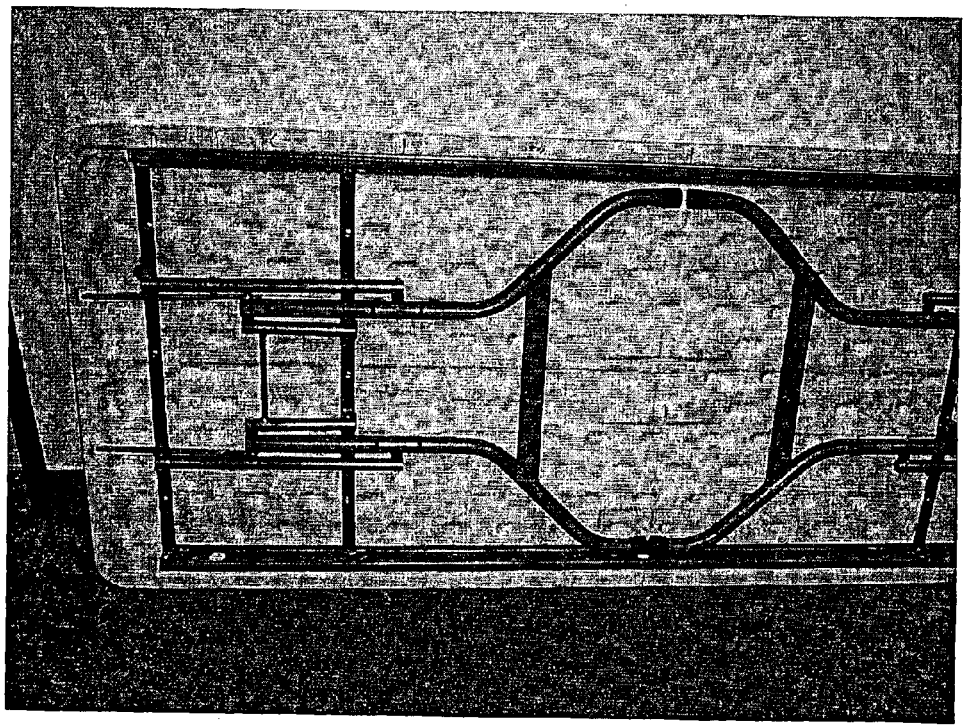
FIG. 4 is the exemplary table of FIG. 3 with both pedestals in closed configuration.

FIG. 2 depicts a detail view of the pivotable/slidable couplings in contemplated tables, wherein the table is in a partially closed configuration. FIG. 3 depicts a detail view of the table of FIG. 2 in a still further partially folded configuration, and FIG. 4 shows the table of FIG. 1 in a closed configuration.

Thus, in a particularly preferred aspect of the inventive subject matter, contemplated tables will include a table top that is coupled to a frame, that includes a first and a second side rail, a first and a second end rail, and a cross rail. Contemplated tables further include a pedestal disposed between the first and second side rails and coupled to the frame via a first and second swivel bar and a first and second pivot bar, wherein the first and second swivel bars are pivotably coupled to the pedestal and pivotably coupled to the cross rail, and wherein the first and second pivot bars are pivotably coupled to the pedestal and pivotably coupled to the end rail. Such tables will still further include a connector that is pivotably coupled to at least one of the pedestal and the first or second swivel bars, wherein the connector is further coupled to at least one of the pivot bars such that the connector limits a movement in which the table is unfolded from a closed configuration to an open configuration.

With respect to the table top, it is generally preferred that the table top is fabricated from a light-weight material and especially preferred materials include blow molded plastic. However, it should be recognized that numerous alternative table tops may also be employed in conjunction with the teachings presented herein, and suitable table tops include those fabricated from plastic (e.g., polyethylene, polystyrene, polycarbonate, polyamide), metal (e.g., aluminum, titanium), wood, fiberglass, textile materials, and all reasonable combinations thereof.

Furthermore, it should be recognized that the dimensions of the table top may vary considerably, and that a particular dimension will generally (and at least in part) depend on the particular purpose for the table. For example, where a table is used as a platform for display of light-weight material (e.g., papers, brochures, etc.) in a trade show, suitable table dimensions may be between 5–8 feet in length and 3–4 feet in width. On the other hand, where contemplated tables are to support relatively heavy loads in a chemically aggressive environment (scientific instruments in a laboratory), suitable table dimensions may be between 3–5 feet in length and 2–4 feet in width.

It is still further especially preferred (but not necessary) that contemplated tables will include an upper circumferential edge (coplanar with the table top upper surface) and a lower circumferential edge (extending below the lower surface of the table top and thus forming a rim). In tables using such table tops, it is desirable that the pedestal in the closed configuration will be disposed between the upper and lower circumferential edge to facilitate stacking of the tables in closed configuration (e.g., the lower circumferential edge of one table will contact the upper circumferential edge or table top of the next table in a stack of tables).

Additionally, or alternatively, contemplated table tops may further comprise an element that releasably engages with at least one of the pedestal, the pivot bar, the connector, and the swivel bar when the pedestal is in the closed configuration. Particularly suitable elements are preferably elastic protrusions and/or indentations from the underside of the table top that receive the respective element of the four bar link or pedestal to retain the respective element of the four bar link or pedestal.

With respect to suitable connectors, it is contemplated that the connector may have various shapes, configurations, and/or coupling points with the pivot bar, swivel bar, pedestal, and/or frame. However, it is generally preferred that the connector is coupled to the table such that the connector limits a movement in which the table is unfolded from a closed configuration to an open configuration. The term "the connector limits a movement in which the table is unfolded from a closed configuration to an open configuration" as used herein means that the connector is configured and/or coupled to the table in such a manner that (a) the pedestal can be moved from a closed configuration into a predetermined open configuration (e.g., in which the pedestal and the table top form an angle of 70, 75, 80, 85, or 90 degrees), and (b) that the connector will prevent movement of the pedestal beyond the predetermined open configuration.

Therefore, in one aspect of the inventive subject matter, suitable connectors may be coupled to the table as depicted in FIG. 1 in which one end of the connector is pivotably coupled to the pivotal coupling of the top end of the pedestal and the swivel bar, and in which the connector is further coupled to the pivot bar via a pin (or other protruding element) that slidably engages with a corresponding slot in the connector. Alternatively, the connector may also include a pin that slidably engages with a corresponding slot in the pivot bar. Still further contemplated alternative modes of coupling include those in which the connector is telescopingly coupled to the pivot bar. Of course, the exemplary above alternative modes of couplings may also be reversed such that the pivotable coupling of the connector is with the pivot bar and the slidable and/or telescoping engagement is with the pedestal/swivel bar joint. Additionally contemplated alternative modes include those in which the connector is pivotably (and/or slidably/telescopingly) coupled to only the swivel bar or only the pedestal.

Furthermore, and depending on the particular configuration of the table, it should be recognized that the table may have one or more connectors. However, contemplated tables will typically have a pair of connectors where the table has a pedestal as depicted in FIG. 1. Additionally, and especially where it is desirable that the table is further secured in the open configuration, it is contemplated that the connector (and most preferably where the connector has a slot along which a pin of the pivot bar slides) includes a locking element that temporarily locks the connector in a fixed position relative to the pivot bar and/or pedestal or swivel bar. For example, the connector may include one or more bays in the slot in which the pin of the pivot bar can rest. Such locks would advantageously allow a choice of predetermined positions of the pedestal relative to the table top. Alternatively, a screw or other compressing element may be positioned at the end of the pin of the pivot bar that prevents slidable movement of the connector relative to the pivot bar (and thereby temporarily fixes the position of the pedestal relative to the table top).

With respect to the pedestal, it is generally contemplated that the configuration may vary considerably, and all known pedestals for tables are considered suitable for use herein. For example, especially preferred pedestals will include two load-bearing columns that may be straight or curved, and that are preferably coupled to each other for improved stability and/or coordination of movement from the open to the closed configuration. Alternatively, single-post or multi-post pedestals with two or more attached feet may be coupled to the frame. Therefore, contemplated tables will include those in which the pedestal has a width that is substantially less than the side-to-side width of the table top. For example, suitable pedestals may have a width WP at the pivotal coupling of the pedestal to the swivel bar, while the table top has a side-to-side width WT, wherein WP is no greater than 0.8, and more typically no greater than 0.6 times WT.

It should be especially appreciated that suitable pedestals are pivotably coupled to both, the swivel bar(s) and the pivot bar(s). Thus, depending on the particular location of the coupling and the configuration of the connector, it should be recognized that the pedestal will be in a rectangular position (relative to the table top) when the table is in an open configuration, or form an angle with the table top, preferably of less than 85 degree, when the pedestal in an open configuration. Thus, it should be recognized that the location of coupling of the swivel bar and/or the pivot bar to the pedestal may vary substantially. However, it is generally contemplated that the swivel bar is pivotably coupled to the pedestal at the upper end (e.g., via an end cap, or cuff) or a position near the upper end of the pedestal (typically no more than 25% of the length of the pedestal away from the end of the pedestal). Similarly, it is contemplated that the position of pivotably/telescopingly coupling of the pivot bar to the pedestal may vary substantially, but it is generally preferred that the coupling is below the pivotable coupling of the pedestal to the swivel bar. As will be readily appreciated, the position of coupling of the pivot bar to the pedestal will at least to some degree determine the angle of the pedestal in the open configuration.

Thus, it should be especially recognized that contemplated tables exhibit significantly improved protection against unintentional collapse. Among other things, a force that is exerted in an end-to-end fashion must have sufficient strength to increase the angle that is formed between the pedestal and the table top over 90 degrees. Such forces, however, will most likely push the table over the surface on which the table stands (especially where wheels or other rolling or sliding elements are coupled to the pedestal). Still further, contemplated configurations will provide substantial stability and rigidity to the table at a relatively low weight.

With respect to the frame, it is generally contemplated that the frame may be fabricated from a variety of materials, and it should be appreciated that all known materials for table frames are considered suitable for use in conjunction with the teachings presented herein. However, particularly preferred materials include metals, alloys, fiberglass, polymeric materials, and all reasonable combinations thereof. End rails and cross rails may be coupled to the side rails in various manners, and it should be recognized the particular manner of coupling is not critical to the inventive subject matter. For example, the frame may be permanently assembled (e.g., welded, bolted, unitary construction) or non-permanently (e.g., screwed) assembled. Similarly, the shape of suitable side and end rails may vary considerably. However, it is generally preferred that the side and end rails may have a Z-profile, or may be tubular structures (round or rectangular). Furthermore, additional side rails and/or end rails may be included into the frame to provide various functions.

Suitable frames may further have any size relative to the table top, so long as the frame at least partially supports the table top. However, in especially preferred aspects of the inventive subject matter, the frame has a length and width that is less than the length and width of the table top. Furthermore, in especially preferred aspects of the inventive subject matter, the cross rail is coupled to the side rails at a distance CD from one end of the frame, the swivel bar has a length LS and the connector has a length CN, wherein CD is greater or equal than CN+LS. Still further, it should be recognized that the frame may be configured such that the frame can be folded into a more compact size. For example, the frame may include a joint in the side rails that allows further folding of the table (provided that the table top is foldable as well or comprises two separate elements).

Viewed from another perspective, contemplated foldable tables will include at least a table top coupled to a frame, and a pedestal that is movably coupled to the frame via a first and second element, wherein first and second elements are pivotably coupled to the frame, and wherein a connector couples the first and second elements such that the connector limits a movement in which the table is unfolded from a closed configuration to an open configuration. With respect to the table top, the frame, the first (e.g., swivel bar) and second (e.g., pivot bar) elements, and the mode of coupling, the same considerations as described above apply.

Thus, specific embodiments and applications of foldable tables have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A foldable table comprising:

a table top coupled to a frame that includes a first and a second side rail, a first and a second end rail, and a cross rail;

a pedestal disposed between the first and second side rails and coupled to the frame via a first and second swivel bar and a first and second pivot bar;

wherein the first and second swivel bars are pivotably coupled to the pedestal and pivotably coupled to the cross rail;

wherein the first and second pivot bars are pivotably coupled to the pedestal and pivotably coupled to the end rail; and a connector that is pivotably coupled to at least one of the pedestal and the first or second swivel bars, wherein the connector is further coupled to at least one of the pivot bars such that the connector limits a movement in which the table is unfolded from a closed configuration to an open configuration.

2. The table of claim 1 wherein the table top comprises a blow mold table top.

3. The table of claim 1 wherein the pedestal comprises two load-bearing columns that are coupled to each other.

4. The table of claim 1 wherein the pedestal has a width WP at the pivotal coupling of the pedestal to the swivel bars, and the table top has a side-to-side width WT, and wherein WP is no greater than 0.8 times WT.

5. The table of claim 1 wherein the pedestal has a width WP at the pivotal coupling of the pedestal to the swivel bars, and the table top has a side-to-side width WT, and wherein WP is no greater than 0.6 times WT.

6. The table of claim 1 wherein the connector is slidably coupled to the at least one of the pivot bars.

7. The table of claim 1 wherein the connector is telescopingly coupled to the at least one of the pivot bars.

8. The table of claim 1 wherein the pedestal and the table top form an angle of less than 85 degree when the table is in an open configuration.

9. A foldable table comprising a table top coupled to a frame, and a pedestal that is movably coupled to the frame via a first and second element, wherein first and second elements are pivotably coupled to the frame and pivotably coupled to the pedestal, and wherein a connector couples the first and second elements such that the connector limits a movement in which the table is unfolded from a closed configuration to an open configuration.

10. The table of claim 9 wherein the table top comprises a blow mold table top.

11. The table of claim 10 wherein the frame comprises a first and a second side rail, a first and a second end rail, and a cross rail.

12. The table of claim 11 wherein the first element comprises a swivel bar and the second element comprises a pivot bar.

13. The table top of claim 12 wherein the swivel bar is pivotably coupled to the pedestal and the cross rail, and wherein the pivot bar is pivotably coupled to the pedestal and to the end rail.

14. The table top of claim 13 wherein the connector is pivotably coupled to the pedestal and at least one of the swivel bar and the pivot bar.

* * * * *